US005393291A

United States Patent [19]

Wingerter

[11] Patent Number: 5,393,291

[45] Date of Patent: Feb. 28, 1995

[54] MINI CASE ERECTOR

[75] Inventor: Conrad C. Wingerter, Yakima, Wash.

[73] Assignee: Marq Packaging Systems, Inc., Yakima, Wash.

[21] Appl. No.: 89,224

[22] Filed: Jul. 8, 1993

[51] Int. Cl.[6] ..... B31B 5/80; B31B 5/72; B31B 3/78

[52] U.S. Cl. ..... 493/116; 493/117; 493/316; 493/317

[58] Field of Search ..... 493/116, 117, 123, 124, 493/125, 126, 127, 183, 316, 317

[56] References Cited

U.S. PATENT DOCUMENTS

| | | | |
|---|---|---|---|
| 3,420,036 | 1/1969 | Hutchinson . | |
| 3,443,357 | 5/1969 | Bacon et al. . | |
| 3,451,318 | 6/1969 | Arnaudon et al. | 493/319 |
| 3,739,696 | 6/1973 | Pearson | 493/316 |
| 3,753,333 | 8/1973 | Derderian et al. . | |
| 3,959,950 | 6/1976 | Fukuda . | |
| 4,081,945 | 4/1978 | Calvert et al. . | |
| 4,285,682 | 8/1981 | Moss | 493/183 |
| 4,348,853 | 9/1982 | Morse et al. . | |
| 4,414,789 | 11/1983 | Pattarozzi . | |
| 4,537,649 | 8/1985 | Ulrich et al. . | |
| 4,569,182 | 2/1986 | Leuvering . | |
| 4,627,830 | 12/1986 | Smidt | 493/316 |
| 4,643,707 | 2/1987 | Marchetti . | |
| 4,846,921 | 7/1989 | Lerner et al. . | |
| 4,854,111 | 8/1989 | Roberts et al. . | |
| 4,889,581 | 12/1989 | Ulrich et al. . | |
| 4,917,659 | 4/1990 | Mohaupt et al. | 493/316 |
| 4,930,291 | 6/1990 | Boisseau . | |
| 5,024,640 | 6/1991 | Saitoh | 493/183 |
| 5,121,586 | 6/1992 | Focke . | |
| 5,154,041 | 10/1992 | Schneider . | |
| 5,186,706 | 2/1993 | Hartness et al. | 493/309 |

FOREIGN PATENT DOCUMENTS

| | | | |
|---|---|---|---|
| 5-138773 | 6/1993 | Japan | 493/183 |

*Primary Examiner*—William E. Terrell
*Attorney, Agent, or Firm*—Christensen, O'Connor, Johnson & Kindness

[57] ABSTRACT

An apparatus for erecting cases from flat blanks (20'). The apparatus includes a frame (42), a hopper (48), a vacuum arm (68), minor flap folders (80), major flap folders (90, 108), a case pusher bar (98), and a tape applicator (112). The frame includes a deck (54). The hopper is attached to the frame at an input end (144) of the frame. It includes guide members (58) to receive a stack of the flat blanks. The vacuum arm is attached near a feed end (124) of the hopper. The arm has vacuum suction cups (70) to pull the flat cases from the hopper into a tubular configuration against the deck. The trailing and leading minor flap folders are arranged and configured to fold the trailing and leading minor flaps, respectively, of a case after it has been pulled from the hopper. The top major flap folder is positioned above the deck near the feed end of the hopper. It folds the top major flap after a case has been pulled from the hopper. The bottom major flap folder is disposed beneath the deck. It is arranged and configured to rise partially above the deck to fold the bottom major flap. The case pusher bar advances a case out of the output end (46) of the frame. The tape applicator is disposed above the deck adjacent to the bottom major flap folder. It applies a strip of pressure sensitive tape (114) across the major flaps before the case is ejected.

22 Claims, 8 Drawing Sheets

22
46
42
54
120
78
196
102
40
194
112
192
94
90
122
166
92
50
58
60
62
200
56
52
48
208
124
204a
44
126
64
38
74
84
198
88
72
82
76
256
248
204
106
104
240
242
238
234
236
244
178
108
110
98
128
66
96
100
80
86

MINI CASE ERECTOR

FIELD OF THE INVENTION

This invention relates generally to apparatus for erecting cases and, more particularly, to an improved apparatus for erecting open-top cardboard boxes by pulling collapsed blanks into a tube shape and folding and taping the bottom flaps.

BACKGROUND OF THE INVENTION

Mechanized case erectors of one type or another have been on the market for several years. Mechanized case erectors save time in large packaging operations where the high quantity of erected cases needed justifies the typically high expense of such case erectors. Not only are mechanized case erectors expensive to manufacture, they are expensive to operate because they also have special setup, operating and maintenance requirements such as high voltage power, and special servicing of internal systems. They are also large and, thus, require significant floor space. As noted above, the cost of prior art mechanized case erectors, their operational cost and floor space are acceptable by packagers having a constant need for a large number of erected cases.

In the past, the small volume packagers sometimes have been unable to justify the purchase of prior art mechanized case erectors due to the high manufacturing and operational costs associated with such machines. As a result, small volume packagers have usually resorted to erecting cases by hand. Case erection by hand can be expensive. Further, it can lead to medical problems, such as carpal tunnel syndrome, which can lead to workmen's compensation expense.

Several of the above-discussed limitations and many others inherent in prior art mechanized case erectors are apparent from an examination of the patents that have issued on such machines. For example, a complicated wrap-around packaging method is disclosed in U.S. Pat. No. 4,569,182 to Leuvering. Flat blanks are folded and an object is inserted. Minor and major flap folding bars are used (see FIG. 1), as well as vacuum suction cups (see FIG. 3, element 46 and Col. 5, lines 43–50). This is a complicated system designed to deal only with specific needs. The machine is designed to handle a single object of a set size. Adjustments would be difficult and standard blanks are not used.

Another large, complicated and expensive case erector is disclosed in U.S. Pat. No. 4,348,853 to Morse et al. This case erector pulls a blank from a stack and carries it over a long course through bars and along conveyors to prepare it for the insertion of objects therein. The space requirements for this machine may be prohibitive in many environments. Also the machine is not readily adjustable for differing case sizes.

Another apparatus for erecting cases is disclosed in U.S. Pat. No. 4,414,789 to Pattarozzi. Through a complicated means, all flaps are folded at one station before the case is advanced to be strapped. The case erector uses a complicated mechanically synchronized setup including vacuum cups and mechanized flap folders without pneumatic actuators. Large portions of the machine are moved along guide tracks to fold the case flaps. The machine does not easily accommodate cases of different sizes.

U.S. Pat. No. 4,081,945 discloses a conveyor system for erecting cases. Chain and cam-driven pneumatically actuated vacuum cups, pusher bars, and a folder bar are combined along the conveyor system. The machine requires a large area in which to operate since it uses a linear series of steps to fold the case flaps. This machine also is difficult to adjust for different sized cases.

Another packaging system is disclosed in U.S. Pat. No. 3,959,950 to Fukuda. This is also a linearly arranged system with static and moving folder bars. Problems with this system include having to manually open the case, large space requirements, and non-conventional case blanks. As can be seen in FIGS. 1*a*, 1*b*, and 2, the bottom minor flaps are each cut into three portions to be able to ride along the conveyor system of the apparatus.

The above-referenced patents illustrate typical limitations and disadvantages of the devices and methods currently in use to erect cases. Besides the specifics discussed in connection with these devices, other limitations such as cost and power requirements also commonly exist. From the above discussion, it should be apparent that an affordable, small, reliable, easy-to-use case erector for use by packagers with smaller quantity applications and/or limited space is not currently available. The present invention was developed to meet this need. As will be understood from the following discussion the present invention provides significant advantages over the prior art devices and methods for erecting cases from blanks for use in containing materials.

SUMMARY OF THE INVENTION

In accordance with this invention, a mini case erector for erecting cases from flat blanks is disclosed. The blanks are pulled into tubes that are oriented such that the blanks have leading and trailing minor flaps and top and bottom major flaps. The mini case erector includes a frame, a hopper, a case puller, trailing and leading minor flap folders, top and bottom major flap folders, and a case advancement mechanism. The frame includes a deck, an input end and an output end. The hopper is attached to, and disposed at, the input end of the frame. The hopper has a loading end and a feed end, and includes chutes arranged and configured to receive a stack of flat blanks. The case puller is attached to the frame and disposed near the feed end of the hopper. The case puller includes grippers for pulling a flat case from the feed end of the hopper into a tubular configuration with four faces, one of the faces being against the deck. The trailing minor flap folder is attached to the frame and disposed on one side of the case puller near the feed end of the hopper. The leading minor flap folder is attached to the frame and disposed on the same side of the case puller and the deck as the trailing minor flap folder. The leading minor flap folder is positioned nearer the output end of the frame than the trailing minor flap folder. The top major flap folder is attached to the frame and positioned above the deck near the feed end of the hopper. The bottom major flap folder is attached to the frame and disposed beneath the deck. The bottom major flap folder is arranged and configured to rise partially above the deck to fold the bottom major flap. The case advancement mechanism is coupled to the frame and travels along the length of the deck to advance cases out of the output end of the frame.

In accordance with a particular preferred aspect of this invention, a tape applicator for securing the flaps in a closed position is also included. The tape applicator is attached to the frame and disposed near the output end to secure the flaps after the flap folding has taken place, as a case is advanced by the case advancement mechanism.

In accordance with another preferred aspect of this invention, the top major flap folder comprises a linear actuator and a fold plate. The fold plate has a longitudinal axis that lies parallel to the direction of movement of the case on the deck. The length of the fold plate is such that at least a portion of the major flaps are closed by the tape applicator before the top major flap passes completely beyond the fold plate as a case is advanced by the case advancement mechanism.

In accordance with a further preferred aspect of this invention, the grippers that pull a flat case from the feed end of the hopper comprise vacuum suction cups.

In accordance with yet another preferred aspect of this invention, the case puller, the minor flap folders, and the major flap folders include separate pneumatic actuators for each. The movements of the case puller, the minor flap folders, and the major flap folders are all controlled by the pneumatic actuators. The minor flap folders are disposed completely beneath the deck when not actuated. The leading and the trailing minor flap folders further include leading and trailing minor flap folder arms and leading and trailing barrel cams. The barrel cams have cam paths such that the arms move upwardly, from beneath the deck, and inwardly, toward each other, when actuated.

In accordance with a still further preferred aspect of this invention, the case advancement mechanism comprises a case pusher bar disposed beneath the deck that is extendible above the deck by means of a pusher bar pneumatic actuator. The advancement mechanism further includes a drive mechanism for moving the case pusher bar in a direction parallel to the deck.

In accordance with still another preferred aspect of this invention, each of the minor flap folders, the bottom major flap folder, and the case advancement mechanism has the ability to move beneath the deck when not in use. During a complete cycle of the mini case erector, each of these components moves beneath the deck for a-time.

In accordance with the preferred embodiment of this invention, the mini case erector includes adjustment mechanisms for adjusting to the dimensions of cases of various sizes.

In accordance with a yet further preferred aspect of this invention, the bottom major flap folder is disposed on the output side of the leading minor flap folder. The bottom major flap folder is actuated when the case is advanced at least partially over the bottom major flap folder.

In accordance with the preferred embodiment of this invention, guide members are attached to the frame. The guide members are configured and arranged to maintain the case in a proper position on the deck by substantially inhibiting lateral and vertical movement along at least a portion of the length of the deck.

This invention is also directed to a method of erecting cases. The steps of the method are generally consistent with the function provided by the elements of the apparatus discussed above.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
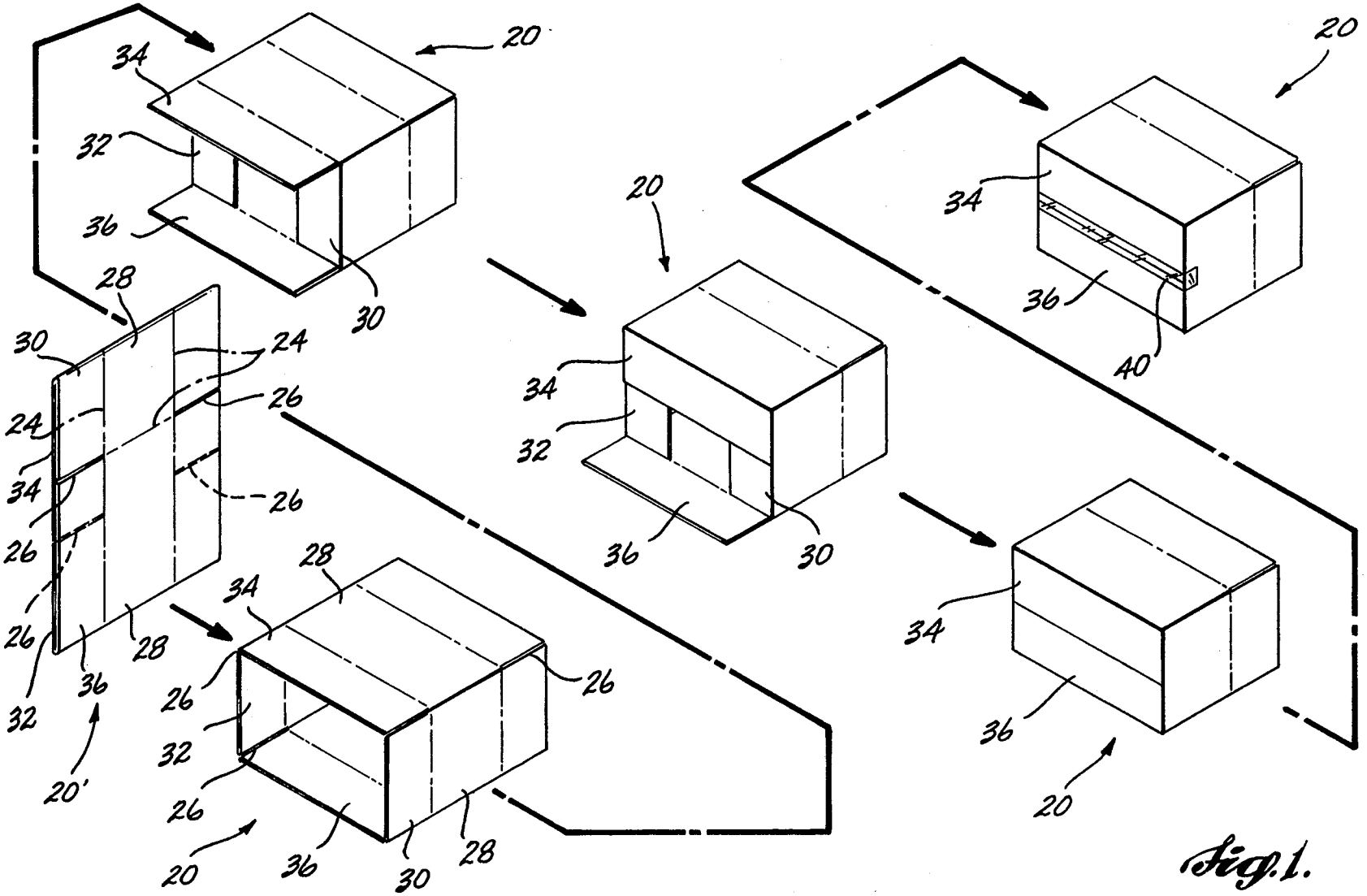
FIG. 1 illustrates the various case configurations that occur as an apparatus formed in accordance with the present invention folds and tapes the bottom flaps of a case.

FIG. 1 illustrates the process that a case 20 goes through when erected by a case erector 22 (FIG. 2) formed in accordance with the present invention. The case 20 is supplied to the case erector as a flat case blank 20'. The case includes fold lines 24 and slits 26 for sidewalls 28 and flaps 30, 32, 34, 36 that were introduced into case blank 20' when the blank was manufactured. As illustrated, the case blank 20' is first pulled into a tubular configuration, flaps extended. Next, the minor flaps 30, 32 are folded inwardly. Then the top major flap 34 is folded downwardly and holds the minor flaps 30, 32 in place. Pulling the case blank 20' down into a tubular configuration, folding the minor flaps 30, 32 inwardly, and folding the top major flap 34 down are all performed at an erection station 38 of the case erector 22. The case 20 then begins to move. As this occurs, the bottom major flap 36 is folded upwardly closing the bottom of the case. As soon as the bottom major flap 36 is folded, tape 40 is applied across the intersection between the top major flap 34 and the bottom major flap 36 to seal the folded flaps of the bottom of case 20. The case 20 is then ejected from the case erector 22 as an open top case ready to be filled.

Figure 2:
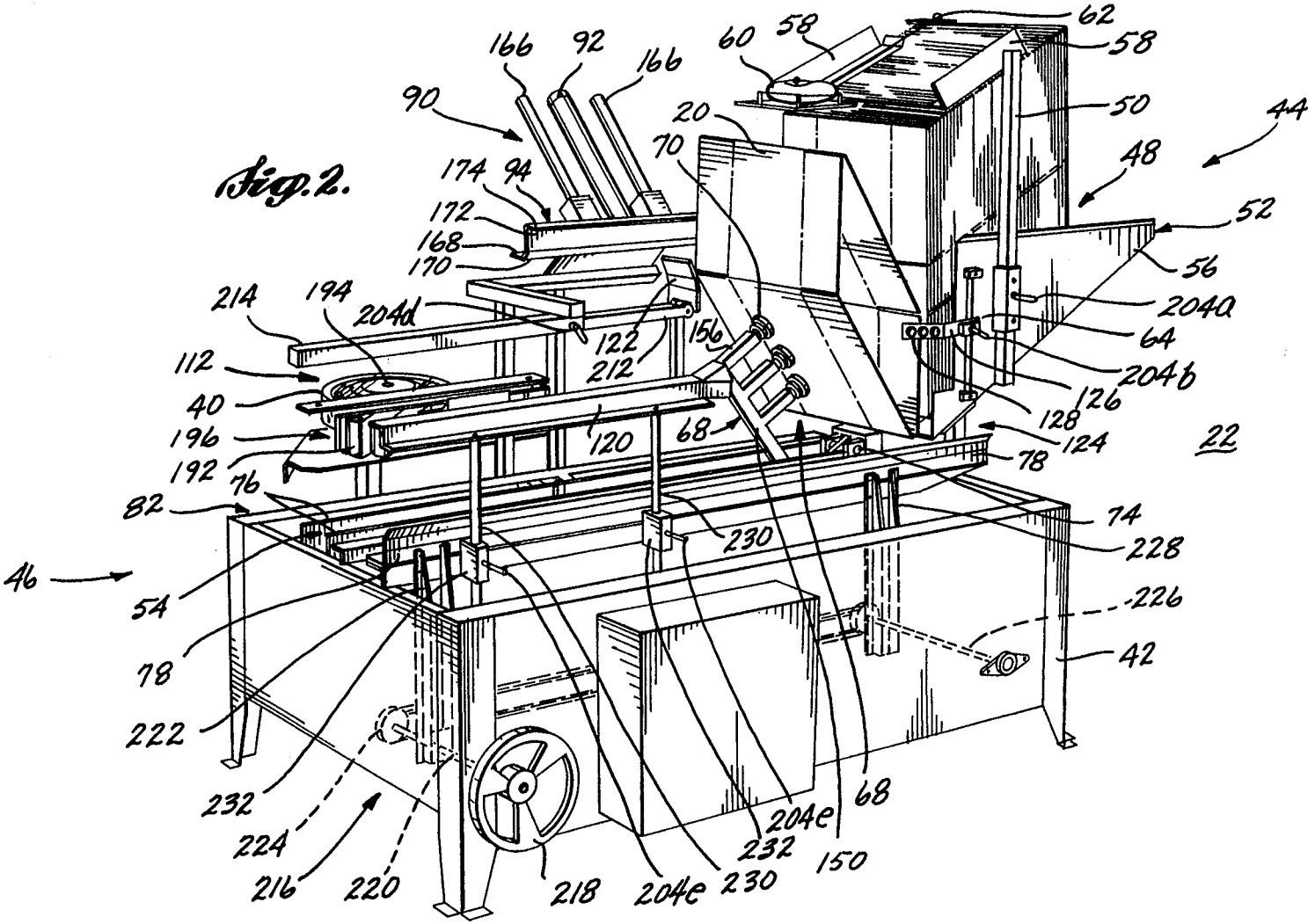
FIG. 2 is a perspective view of a preferred embodiment of an apparatus formed in accordance with the present invention, illustrating the basic arrangement of the above-the-deck components and the side guide angle adjustment mechanism.
Figure 3:
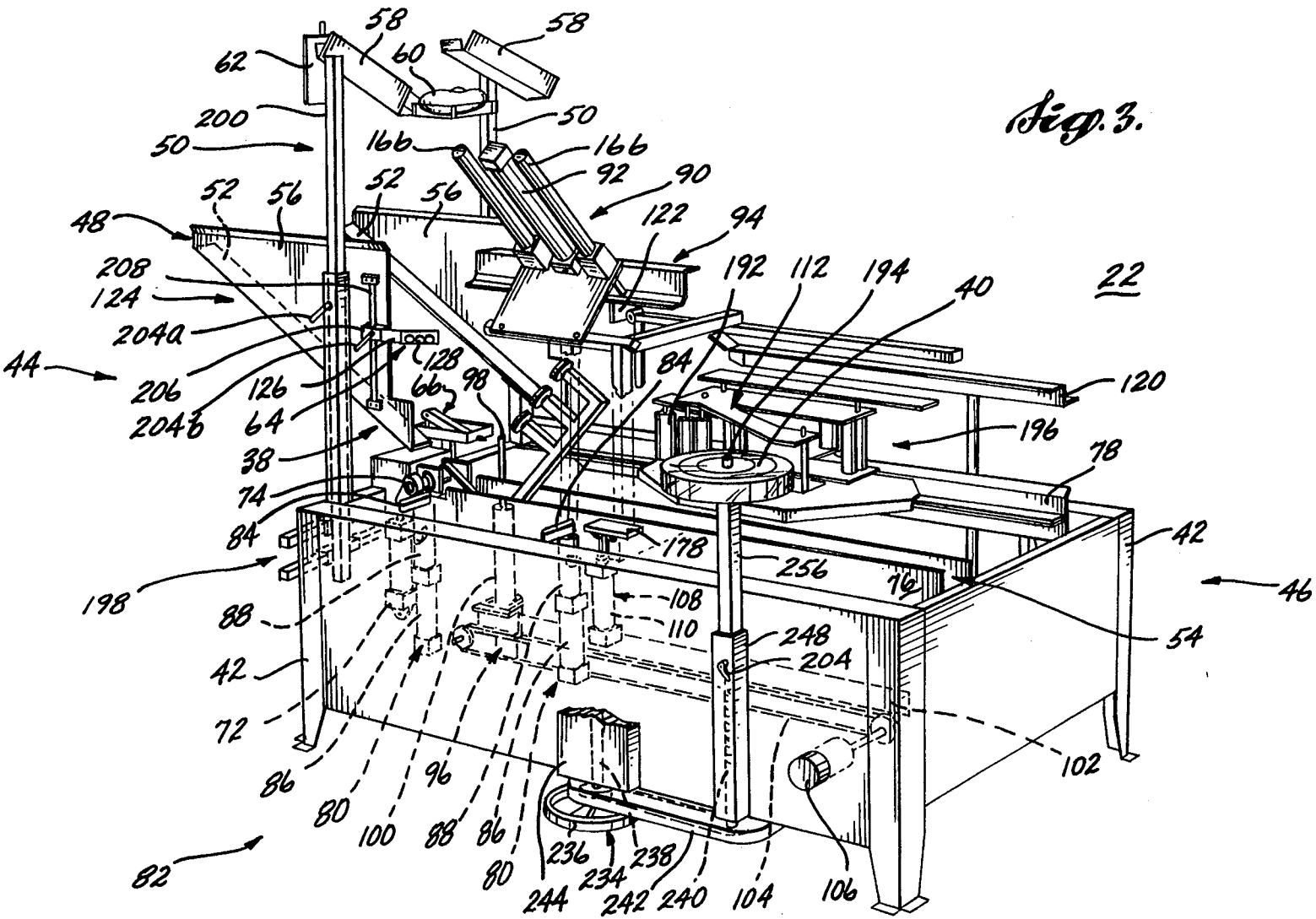
FIG. 3 is a further perspective view of the embodiment of the invention shown in FIG. 2, illustrating the placement of the case erector mechanisms.

The following description starts with a general discussion of the case erector components and their relationships one to another in connection with FIGS. 2 and 3. Thereafter, a more detailed look at each step carried out by case erector 22 and the associated mechanism is described in connection with FIGS. 4 through 11.

FIGS. 2 and 3 are general perspective views of a case erector 22 formed in accordance with the present invention. The case erector 22 includes a frame 42 onto which all other components are secured. The frame 42 has a generally right rectangular parallelepiped shape with side panels and legs which support the case erecting components of the case erector 22. The details of attachment of the internal components of the case erector 22 are not shown for clarity of illustration. It should be understood, however, that conventional methods of attachment, obvious to those skilled in this art, are used throughout. The frame 42 has an input end 44 and an output end 46, the flow of cases 20 proceeding from the input end 44 to the output end 46. A hopper 48 that holds case blanks 20' is secured in position at the input end 44 of the frame 42. The hopper 48 includes upright posts 50 located along its sides, which hold in place the hopper chutes 52 that carry the case blanks 20'. The chutes 52 are oriented at an angle of about 30° with respect to the plane of horizontal deck 54 located atop the frame 42 of case erector 22. Vertically oriented case blanks 20' are loaded into the hopper 48 atop the chutes 52, between hopper walls 56. As a result, the case blanks are gravity fed down to the erection station 38. The hopper walls 56 and a pair of upper guide members 58, positioned above case blanks 20', help to direct the flow of the case blanks 20' by holding the case blanks 20' laterally and vertically. A coil spring 60 attached is secured to upper guide members 58. A paddle 62 attached to the end of the coil spring 60 presses against the rear of case blanks 20' and biases them in a forward and downward direction. More specifically, the paddle 62 is connected to the spring 60 with a cable that feeds into the housing in which the spring is located. The paddle 62 is positioned on the top rear corner of the stack of blanks. The cable extends to the spring 60, which is attached to the forward end of the upper guide members 58. The hopper 48 also includes hold back picks 64 and a blank lifter 66, which are described in more detail below. These elements are located at the lower leading edge of the hopper.

A case puller 68 that includes vacuum suction cups 70 is pivotally connected to the frame 42 at the output side of the hopper 48. The case puller 68 is moved by a case puller pneumatic actuator 72 which rotates a puller pivot rod 74 linked to the case puller 68. The vacuum suction cups 70 are connected to a vacuum source (not shown) and are used to pull a case blank 20' from the hopper downwardly into a tubular shape. When a case 20 reaches the tubular shape one side comes to rest on the deck 54. The deck 54 includes a pair of slide bars 76 and a side guide angle 78. The channel 78 and the bars 76 have longitudinal axes which run parallel to the longitudinal axis of case erector 22.

Minor flap folders 80 (FIG. 3) are disposed along a back portion 82 of the case erector 22 behind slide bars 76. The minor flap folders 80 are spaced apart from one another so as to fold the leading minor flap 30 and the trailing minor flap 32 of a case 20 once the case is in tubular shape at erection station 38. The minor flap folders 80 include minor flap folder arms 84 that are moved upwardly and inwardly by pneumatic actuators 86 and barrel cams 88. As described more fully below, such movement causes the minor flap folder arms to rise above the surface of deck 54 and fold the minor flaps 30, 32 of a case inwardly by at least 90°.

A top major flap folder 90 is also positioned on the back portion 82 of the case erector 22, above the minor flap folders 80. The top major flap folder 90 includes a linear actuator 92 and a fold plate 94 that pushes the top major flap 34 of an erected case 20 down. The top major flap folder 90 is also mounted on the case erector frame 42.

A case advance mechanism 96 is secured within the frame 42. The case advancement mechanism includes a vertically oriented case pusher bar 98 located between the slide bars 76 and the side guide angle 78. A vertically oriented pneumatic actuator controls the upward extension of the pusher bar 98. The pusher bar pneumatic actuator 100 is slidably connected to an advance mechanism guide track 102 and is pulled along guide track 102 by a drive chain 104 connected to a drive motor 106. The direction of travel is parallel to the longitudinal axis of the case erector 22. When the case pusher bar 98 is extended upwardly, part of the bar lies behind a case 20 located at the erection station 38. A case 20 is advanced along deck 54 of case erector 22 toward output end 46 by the drive chain 104 pulling the pneumatic actuator away from the hopper. Alter pulling a case a sufficient distance, the case pusher bar 98 retracts and the chain drive 104 returns the case pusher bar 98 and pusher bar pneumatic actuator 100 to their start position behind the case erector station 38. The case pusher bar 98 is advanced after a case 20 is pulled into a tubular shape, the minor flaps 30, 32 are folded, and the top major flap 34 is folded.

As a case 20 is advanced it passes a bottom major flap folder 108 which is activated to pivot upwardly by a pneumatic actuator 110 to fold the bottom major flap 36 of the case. The bottom major flap folder 108 is positioned within the back portion 82 of the case erector frame 42 in line with and on the output side of the minor flap folders 80. At this point, the top major flap 34 is still held in a folded position by fold plate 94 remaining in its downwardly extended position. Both the bottom and top major flaps 36, 34 are then held in their folded positions as the moving case 20 contacts a tape applicator 112.

As a case 20 continues to be advanced, the tape applicator 112 applies a strip of tape 114 beginning on the leading side 116 of the advancing case 20, adjacent to the intersection of bottom and top major flaps 36, 34. As the case 20 is advanced past the tape applicator 112 tape 40 is applied across the intersection of the bottom and top major flaps 36, 34 to the trailing side 118 of the case 20 where the tape 40 is clipped and sealed against the trailing side 118 just before the case 20 exits the output end 46 of the case erector 22.

An upper guide angle 120 positioned above the side guide angle 78 holds the case 20 in position as the case leaves the fold plate 94 and passes the tape applicator 112. The combination of the side guide angle 78 and the upper guide angle 120 resists the force of the tape applicator 112, as well as the force of the bottom major flap folder 108 as they operate to seal the exiting case 20.

The above-described components of the case erector are adjustable so as to conform to various size cases. In one actual embodiment, case erector 22 formed in accordance with this invention, the smallest case that can be erected is 6×6×4 inches and the largest case that can be erected erect is 16×14×14 inches.

Further details of each of the case erecting mechanisms described above are discussed in further detail next in connection with FIGS. 4–10.

Figures 4, 5:
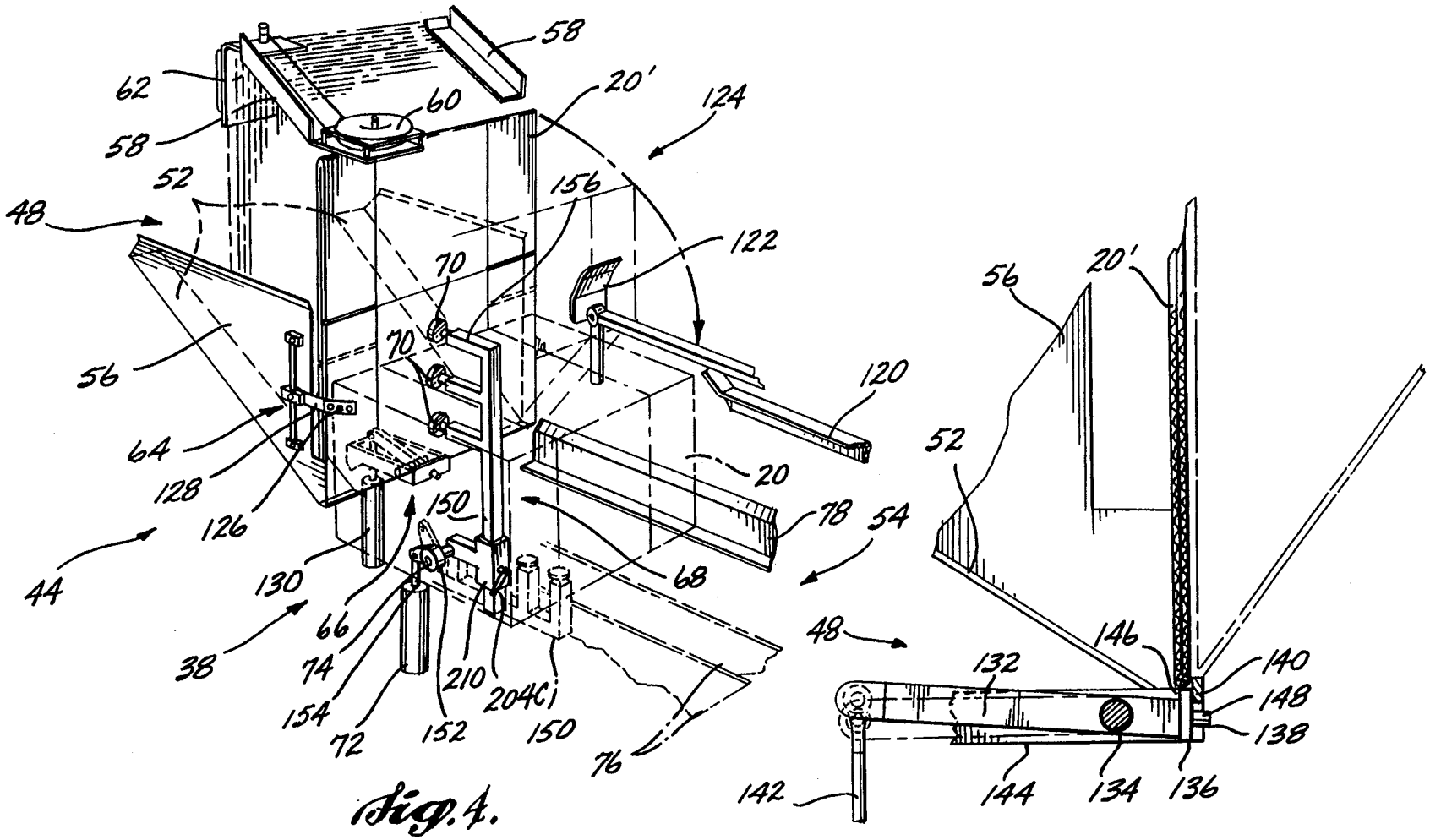
FIG. 4 is a perspective view of a portion of the embodiment of the invention shown in FIGS. 2 and 3 depicting a case blank being pulled down from a hopper into a tubular shape.
FIG. 5 is a partial cross-sectional, elevational view of the mechanical details of the case blank lifter shown in FIG. 4.

FIGS. 4 and 5 illustrate the components of the case erector 22 that combine to pull a case blank 20′ from the hopper 48 into a tubular form on the case erector deck 54. The components that carry out this function include the hopper 48, the hold back picks 64, the blank lifter 66, the case puller 68, a case bumper plate 122, the side guide angle 78, and the slide bars 76.

As described above, the hopper has vertical hopper walls 56 and inclined chutes 52 that lie perpendicular to the hopper walls 56. Vertically oriented case blanks 20′, loaded into the hopper 48 onto the chutes 52, are guided laterally by hopper walls 56. The chutes 52 are sloped at an angle of about 30°, which causes the case blanks 20′ to be gravity fed toward the feed end 124 of the hopper 48. The hold back picks 64, which are attached to feed end 124 of hopper walls 56, and the hold back ridge 140 (described below) of the blank lifter 66, which is positioned below the feed end 124, restrain the leading case blank 20′ from further movement. The hold back picks 64 are secured on the exterior of hopper walls 56. The hold back picks 64 include a hold back spring 126 which has teeth 128 attached along a forward end thereof to grip the leading case blank 20′ located in the hopper 48.

The blank lifter 66 includes a lifter frame 144, an actuator 130, a lifter arm 132, a pivot pin 134, a lift plate 136, a stop rod 138, and a hold back ridge 140 (see FIG. 5). The lifter frame 144 includes parallel left and right arms each having a rear end and a forward end. The rear ends of lifter frame 144 are connected together by a transverse bar and the forward ends of lifter frame 144 are connected by the hold-back ridge 140, which is oriented transverse to the longitudinal axis of the case erector 22. The actuator 130 includes an actuator rod 142 which is attached to the rearward end of the lifter arm 132. The pivot pin 134 extends through the lifter frame 144 and the lifter arm 132 forward of the connection between the actuator rod 142, the lifter arm 132 and the lifter frame 144. Thus, the arm 132 is pivotally attached to the frame 144 about an axis perpendicular to the longitudinal axis of case erector 22. At its forward end, the lifter frame 144 includes transversely oriented hold back ridge 140, which is located in front of the bottom edge 146 of leading case blank 20′ in the hopper. At the forward end of the lifter arm 132, behind the hold back ridge 140, is a transverse lift plate 136. The lift plate 136 is positioned directly below a portion of the bottom edge 146 of the leading case blank 20′ so that when the lift plate 136 rises due to downward movement of the actuator rod 142 the leading case blank 20′ is lifted above the hold back ridge 140, allowing the leading case to be pulled away from hopper 48. The stop rod 138, which rides within a blank lifter channel 148 on the front of lifter frame 144, limits the upward movement of lift plate 136.

The case puller 68 includes a case puller arm 150, a plurality (3) of vacuum suction cups 70, puller pivot rod 74, a pivot bracket 152, and a puller pneumatic actuator 72. The case puller arm 150 includes a shaft with a rectangular cross section pivotally attached to the frame 42 and pivotally driven by the puller pneumatic actuator 72. The case puller arm 150 swings within vertical plane oriented parallel to the longitudinal axis of case erector 22. The puller pneumatic actuator 72 is pivotally attached to the case erector frame 42 at its lower end and includes a puller actuator rod 154 partially housed within an actuator cylinder. The remote end of the actuator rod 154 is attached to the outer end of a pivot arm 152. The pivot bracket arm is affixed to the pivot rod 74. As a result, movement of the actuator rod 154 up and down rotates the pivot arm 152 and the puller pivot rod 74. The puller pivot rod 74 is pivotally attached to case erector frame 42 and positively attached to case puller arm 150. The puller pivot rod 74 is oriented perpendicular to the longitudinal axis of case erector 22. The case puller arm is mounted in a sleeve 210 having an arm 211 affixed to the puller pivot rod 74. The arm lies at right angles to the axis of the case puller arm. As a result, movement of the pivot bracket 152 by the actuator 72 causes the entire case puller arm 150 to pivot about the puller pivot rod 74.

The case puller arm 150 includes puller fingers 156 which extend parallel to each other at right angles to case puller arm 150. A vacuum suction cup 70 is attached at the outer ends of each finger. The fingers 156 extend upwardly when the case puller arm 150 lies beneath the deck 54 and horizontally in the direction of the case blanks 20′ when the case puller arm 150 is pivoted up to pull a case. The vacuum suction cups 70 are attached to a vacuum supply system (not shown). The range of movement of the case puller arm 150 is from an upright position where the vacuum suction cups 70 contact the leading case blank 20′ in the hopper 48 to a position where the arm 150 lies parallel to the longitudinal axis of the case erector 22, beneath the deck 54 of the case erector 22.

The case bumper plate 122 is attached to the frame 42 of the case erector 22 and is positioned above the case erector deck 54 at a location that will intersect a case blank 20′ being pulled down, but be higher than when the case 20 is pulled into a tubular form. The case bumper plate 122 has a somewhat curved cross section with three angles that contact the case blank 20′ as it is pulled down. The convex face of the bumper plate 122 faces the case blanks 20′. The function of the case bumper plate 122 is to contact a flat case blank 20° as the case puller 68 brings it down from hopper 48 and assists in opening the case. More specifically, the case bumper plate 122 contacts an upper portion of a flat case blank 20′ as it leaves the hopper 48. The constant force is sufficient to hold the top of the case blank as the case puller arm 150 continues to pull the case, resulting in the case blank 20′ opening into a tubular configuration.

The slide bars 76 and the side guide angle 78 form the surface of the deck 54 of case erector 22. The slide bars 76 are formed from rectangular plates oriented vertically and extending parallel to the longitudinal axis of case erector 22. One side bar 76 is located on each side of the case puller arm 150. The side guide angle 78 lies parallel to the slide bars 76 and includes an angle within which rests one side of a case 20 after it is pulled from hopper 48. One face of side guide angle is horizontal, another is vertical. After case 20 is pulled down from hopper 48, the bottom face 158 of the case 20 rests on the slide bars 76 and the side guide angle 78.

In summary, the operation of sequentially pulling cases 20 into a tubular form is carried out after flat case blanks 20′ are manually loaded into hopper 48. The vertical blanks are gravity fed down to erection station 38 by two parallel chutes 52. The chutes 52 are mounted on about a 30° incline. The leading case blank 20′ in the hopper 48 is drawn away from the stack by the case puller arm 150. Specifically, the case puller arm 150 raises out of the surface of deck 54 through an angle of 90° to a point where the suction cups contact the front case in the stack. The puller arm 150 holds its upright position momentarily, long enough for the vacuum suction cups 70 to become attached to the leading case blank 20'. Then the puller arm 150 retracts back into deck 54, opening the case 20 with the help of the hold back picks 64 located on each side of the hopper 48 and the case bumper plate 122 located above the deck 54.

Figure 6:
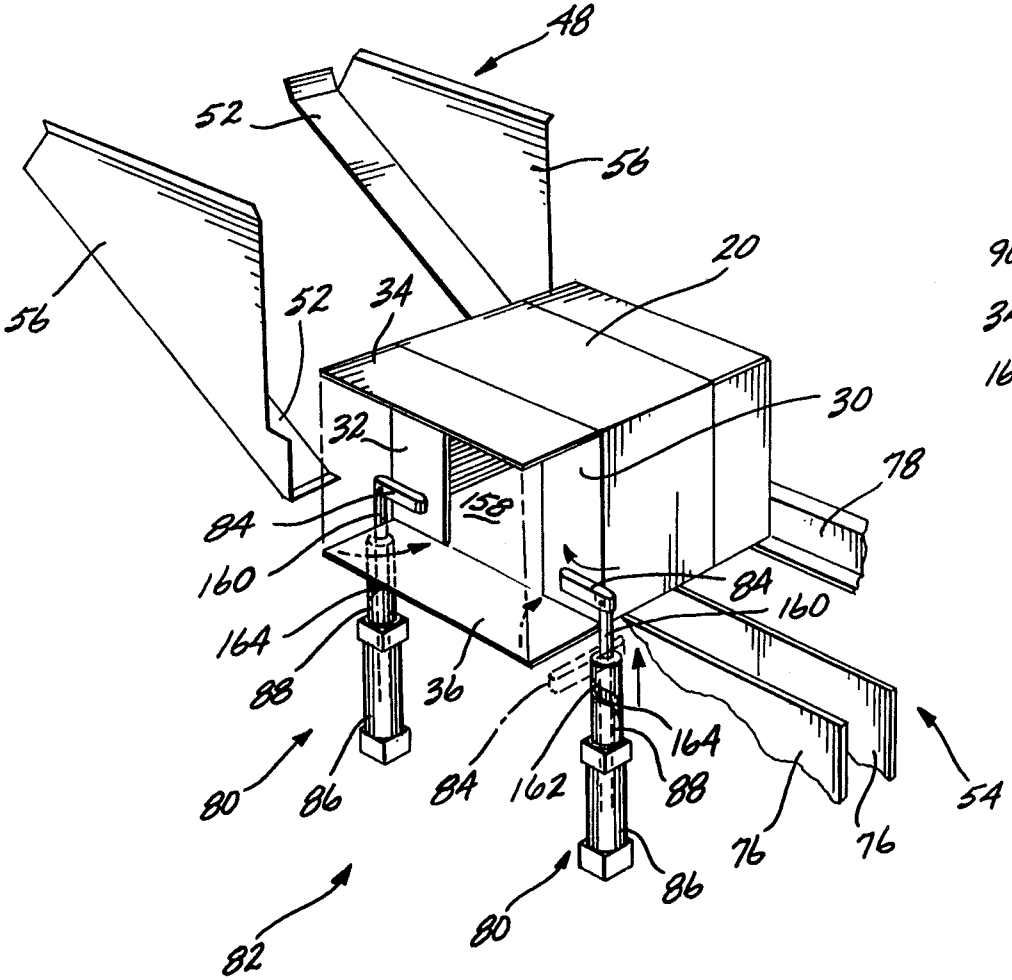
FIG. 6 is a perspective view of the mechanism of the embodiment of the invention shown in FIGS. 2 and 3 that folds the leading and trailing minor flaps.

FIG. 6 illustrates the mechanism for folding the leading and trailing minor flaps 30, 32 of a tubular configured box. After case 20 has been pulled down into a tubular configuration on the deck 54 as described above, the leading and trailing minor flaps 30, 32 are folded inwardly by the minor flap folders 80. The minor flap folders 80 are adjusted in their position along the back side of the case erector 22 to be both just in front of and just behind pulled down case 20 and beneath the deck 54. Once a case 20 is pulled down into a tubular form, flap folder arms 84 rise up and turn inwardly to fold the leading and trailing minor flaps 30, 32. Rising and turning is accomplished by pneumatic actuators 86 and barrel cams 88, both of which are vertically oriented. The pneumatic actuators 86 include minor flap folder rods 160 which have side posts 162 affixed to them. That is, the side posts 162 are affixed to the sides of rods 160. The rods slide inside barrel cams 88 which are mounted on top of pneumatic actuators 86. The barrel cams 88 have cam slots 164 on their sides which slope upwardly and inwardly toward case 20 on deck 54. The side posts 162 ride in the cam slots 164. As a result, when the rods 160 are raised the arms 84 of the flap folders 30, 32 both raise and turn inwardly. The arms are raised enough to move past the bottom flap 36 of the case before the arms move inward. The inward movement folds the leading and trailing minor flaps 30, 32 inward, slightly past 90°. The side guide angle 78 opposes the force that is placed on case 20 by the leading and trailing minor flap folders 30, 32.

Figure 7:
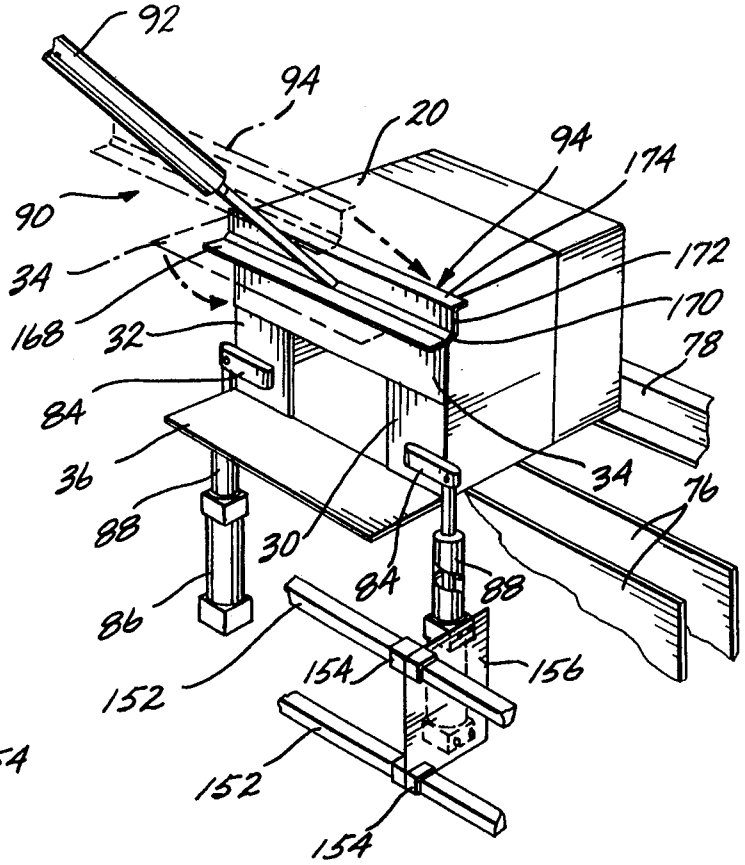
FIG. 7 is a perspective view of the mechanism of the embodiment of the invention shown in FIGS. 2 and 3 that folds the top major flap.

Referring now to FIG. 7, the minor flap folder arms 84 hold the leading and trailing minor flaps 30, 32 in a folded position while the top major flap folder 90 extends downwardly in the direction of the case 20 and folds the top major flap 34 down over leading and trailing minor flaps 30, 32. Leading and trailing minor flap folders 80 can then be retracted since top major flap 34 now holds minor flaps 30, 32 in a folded position. The top major flap 34 folder 90 includes a top linear actuator 92 and a fold plate 94, as well as guide rods 166 (shown in FIGS. 2 and 3). The linear actuator 92 pushes the fold plate 94 into contact with top major flap 34 and, then, it folds the top major flap 34 down 90°. The fold plate 94 is then held in position and keeps the minor flaps 30, 32 and top major flap 34 in a folded position as the arms 84 of the leading and trailing minor flap folders are retracted.

The fold plate 94 has a longitudinal axis that runs parallel to the longitudinal axis of case erector 22. The cross-sectional shape of fold plate 94 includes faces and angles specially designed to fold the top major flap 34. Specifically, the fold plate 94 includes a lower horizontal portion 168 which first contacts the unfolded top major flap 34 and begins to push it in a downward direction as the shaft of the actuator 92 attached to the fold plate 94 extends. An angled portion 170, bent upwardly at about 45° from the lower horizontal portion 168 contacts the top major flap 34 as it is being folded downwardly. The angled portion 170 bends into a vertical portion 172, which pushes against the top major flap 34 as it is folded 90° flat against minor flaps 30, 32. The fold plate 94 continues with a 90° corner into an upper horizontal portion 174, which holds the case 20 down in position during and after the final folding is completed. The 90° angle of the fold plate 94 combined with the 90° angle of the side guide angle 78 combine to hold a case 20 in place and counteract other forces applied to the case as they occur. As noted above, the fold plate 94 stays in position after the top major flap is folded down, while the leading and trailing minor flap folders 80 are retracted. The fold plate 94 remains in position while the case 20 is advanced as explained next.

Figures 8, 9:
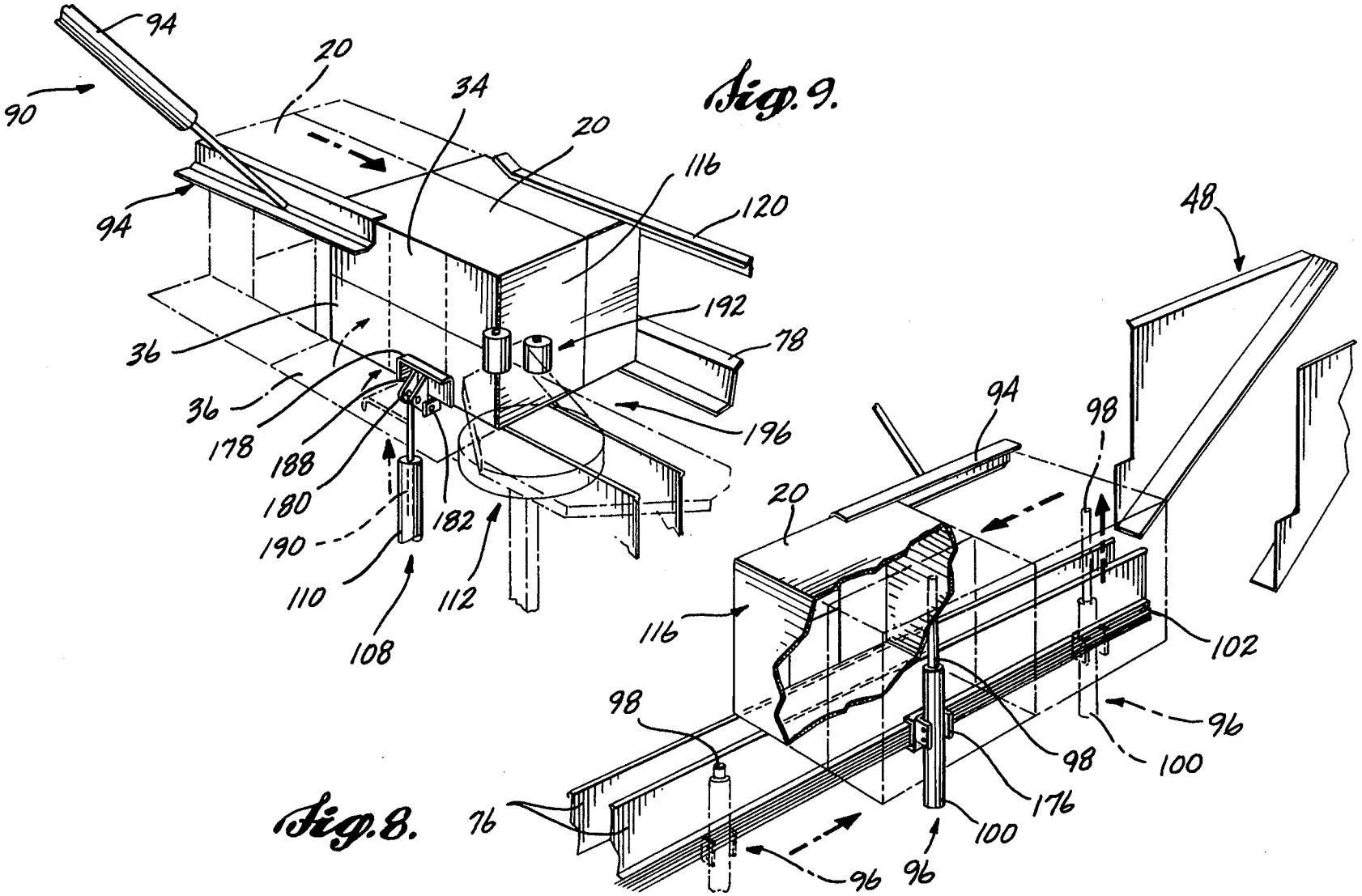
FIG. 8 is a perspective view illustrating the operation of the case pusher bar of the embodiment of the invention shown in FIGS. 2 and 3.
FIG. 9 is a perspective view illustrating the advancement of the case and the folding of the bottom major flap of the embodiment of the invention shown in FIGS. 2 and 3.

The case advance mechanism 96 is illustrated in FIG. 8. The movement of the case 20 in the direction of the output end 46 of the case erector 22 is carried out by the case advance mechanism 96. The case advance mechanism 96 includes a case pusher bar 98, a pusher bar pneumatic actuator 100, a guide track 102, a drive chain 104 (not shown in FIG. 8), and a drive motor 106 (not shown in FIG. 8). The pusher bar pneumatic actuator 100 is secured to a rider bracket 176. The rider bracket 176 rides along the guide track 102 and is driven back and forth by the drive chain 104, which is moved by the drive motor 106. The guide track 102 is secured to the frame 42 under the deck 54 and is oriented parallel to the longitudinal axis of the case erector 22. In one cycle of operation of the case advance mechanism 96, after the minor and top major flaps of the bottom of a case have been folded in the manner described above, the case pusher bar 98 pushes the case 20 out the output end 46 of the case erector 22 and, then, retracts back to a position in front of the hopper 48 (see arrows in FIG. 8). More specifically, starting with the pneumatic actuator 100 beneath the deck 54 and behind the case 20, after top major flap 34 is folded down, the case pusher bar 98 is extended. With the case pusher bar 98 extended, the pneumatic actuator 100 is moved by the drive chain 104, in the direction of the output end 46 of the case erector 22. The case pusher bar 98 advances the case 20 past the bottom major flap folder 108 and through the tape applicator 112 and ejects the case 20 out the output end 46 of the case erector 22. The case pusher bar 98 is then retracted until the upper end lies beneath the deck. Thereafter, the drive chain 104 returns the case pusher bar 98 to its initial position next to the hopper 48. Alternatively, the case advance mechanism 96 could utilize a pneumatic advance actuator (not shown) in place of the drive chain 104 and the drive motor 106.

Referring to FIG. 9, as a case 20 is advanced it proceeds past the bottom major flap folder 108. The bottom major flap folder 108 is activated as the leading edge of the bottom major flap 36 passes over it. The bottom major flap folder 108 includes a bottom flap fold plate 178, a first bottom pivot pin 180, a second bottom pivot pin 182, a fixed bracket 184, and a bottom flap folder pneumatic actuator 110. The fixed bracket 184 is secured to the frame 42 of the case erector 22. Bottom flap fold plate wings 188 extend from the side of the fold plate 178 opposite the side that contacts bottom major flap 36. The bottom flap fold plate wings 188 receive first and second pivot pins 180, 182. The first pivot pin 180 extends through the fold plate wings 188 and is connected to the rod 190 of the flap folder pneumatic actuator 110. The second pivot pin 182 extends through fixed bracket 184 and through the fold plate wings 188. The axis of the second pivot pin 182 is offset from the axis of the first pivot pin 180. As a result, the extension of the actuator rod 190 causes the fold plate 178 to pivot about the second pivot pin 182. The axis offset is such that the fold plate 178 moves above the deck 54 of the case erector 22 and folds the bottom major flap 36 upwardly 90°. The fold plate 178 is then held in this position while the case pusher bar 98 continues to advance the case 20 past the tape applicator 112.

Figure 10:
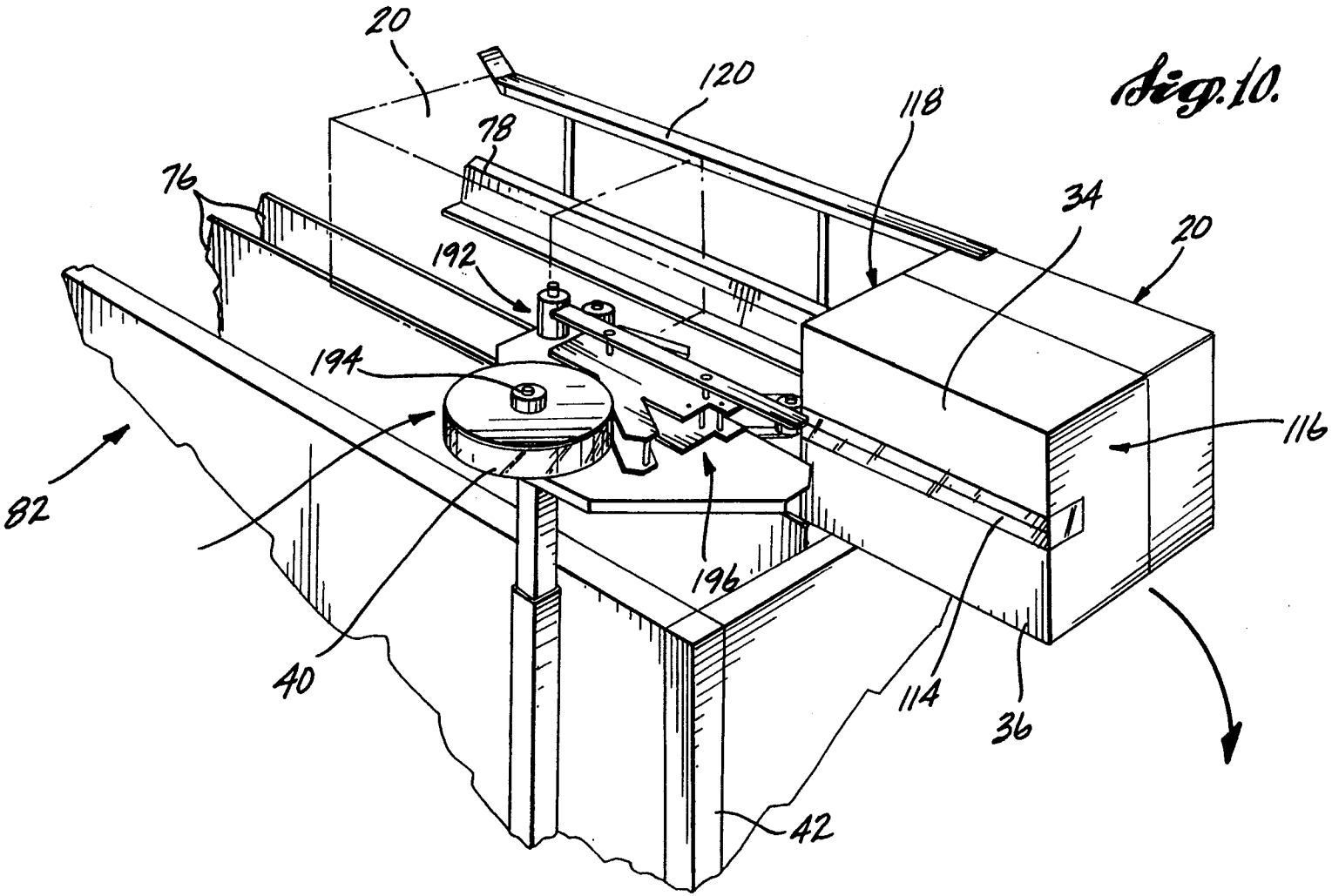
FIG. 10 is a perspective view illustrating the operation of the tape applicator and the invention of the erected case from the case erector of the embodiment of the invention shown in FIGS. 2 and 3.

FIG. 10 illustrated how the case 20 is advanced by the case pusher bar 98 through the tape applicator 112 and out the output end of case erector 22. As mentioned above, the case 20 contacts the rollers 192 of the tape applicator 112 while the top major flap folder 90 and the bottom major flap folder 108 hold the top and bottom major flaps 34, 36 in position. The tape applicator 112 of the present invention is of conventional design and includes a tape roll carriage 194, as well as a roller mechanism 196 that apply the tape 40 across the case 20 beginning on the leading side 116 of the case 20, continuing across the intersection of the top and bottom major flaps 34, 36 and ending partially down the trailing side 118 of case 20. After the flaps 34, 36 of case 20 have been sealed with tape the pusher bar 98 ejects the case 20 out the output end 46 of the case erector 22.

The sequence of operation of case erector 22 is summarized as follows:

1. Case loading hopper: flat case blanks 20' are manually loaded into the hopper 48 in the vertical position, where they are gravity fed down to the erection station 38 of the machine by two paralleled angles making up the chutes 52; the chutes 52 are mounted on a 30° incline;
2. Erection station: the leading case blank 20' in the hopper 48 is drawn away from the stack by means of the vacuum suction cups 70 attached to the case puller arm 150; the case puller arm 150 raises from out of the deck 54 of the case erector 22 and pivots 90° up onto the stack, where the vacuum suction cups contact the front case blank 20' in the stack; the arm 150 holds up in that position momentarily to create a vacuum on case blank 20' and then retracts back into the deck 54, the case blank 20' opens with the help of the hold back picks 64 located on each side of hopper 48 and the case bumper plate 122;
3. Minor flap fold: the leading and trailing minor flaps 30, 32 are folded next by means of two minor flap folders 80, portions of which raise up out of deck 54 and rotate inward in a 90° motion;
4. Top major flap folding: with the minor flap folders 80 holding the minor flaps 30, 32 in, the top major flap folder 90 folds the top flap 34 down 90°;
5. Retract minor flap folders: the minor flap folders 80 are now retracted as the minor flaps 30, 32 are held in place by the top major flap folder 90;
6. Convey the case to the taping station: the case 20 is now moved forward by means of the case pusher bar 98 and the drive chain 104; the pusher bar 98, which is connected to the drive chain 104, raises up behind the case 20; the drive chain 104 then moves the case 20 forward toward the taping station;
7. Bottom major flap fold: just prior to the case 20 contacting the tape applicator 112, the bottom major flap folder 108 pivots up from the deck 54 and folds the bottom major flap 36;
8. Taping station: the case 20 moves past the tape applicator 112, where pressure sensitive tape 40 is applied across the major flaps 34, 36, running parallel with the major flaps 34, 36; and
9. Case eject: the case 20 continues on past the tape applicator 112 and is conveyed out of case erector 22.

Figure 11:
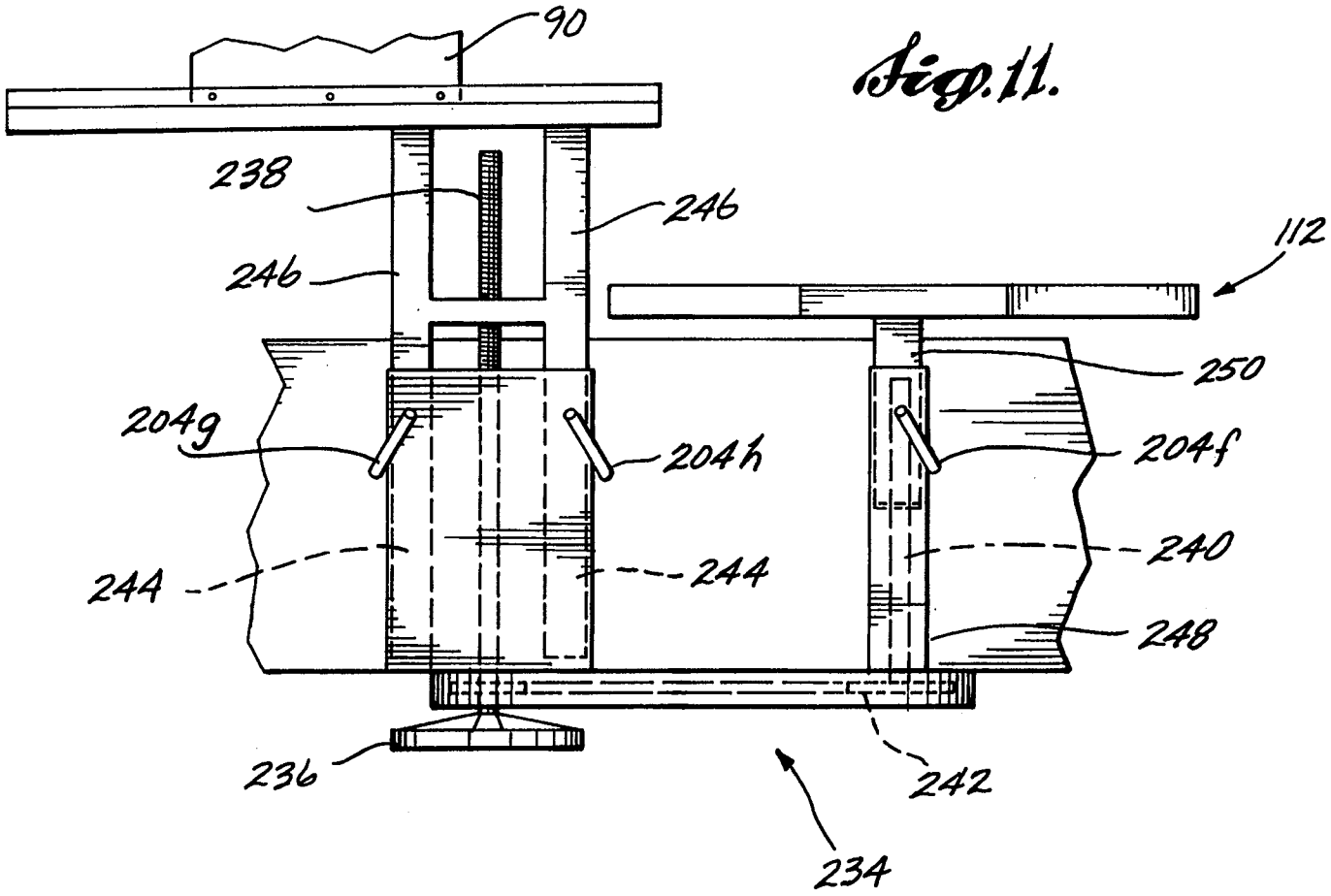
FIG. 11 is a side view illustrating the vertical adjustment mechanism of the embodiment of the invention shown in FIGS. 2 and 3.

The mechanisms of the preferred case erector 22 are adjustable to accommodate various sizes of cases 20 ranging from 16×14×14 inches to 6×6×4 inches. The adjustment mechanisms for the hopper 48, the hold back picks 64, the case bumper plate 122, the side guide angle 78 and the upper guide angle 120 are shown in FIGS. 2 and 3. The adjustment mechanism for the case puller 68 is shown in FIG. 4. The adjustment mechanism for the minor flap folders 80 is shown in FIG. 7. The adjustment mechanisms for the top major flap folder 90 and the tape applicator 112 are shown in FIG. 11.

Beginning with the hopper 48 adjustment mechanisms, the upright posts 50 are adjustable back and forth horizontally by virtue of a sliding engagement arrangement with the hopper adjustment mechanism 198 (see FIGS. 2 and 3). This arrangement allows the hopper walls 56 and chutes 52 to be brought toward and away from one another to accommodate case blanks 20' having narrower or wider widths. The upper guide members 58 are vertically adjustable by virtue of their riding atop upright rods 200 that slide in upright sleeves 202. The rods 200 are clamped in place by turning a screw handle **204*a* that drives a screw (not shown) mounted in the sleeves into contact with rod 200. This allows adjustment for case blanks 20'** of differing heights.

The hold back picks 64 are vertically adjustable to accommodate case blanks 20' of varying dimensions. Specifically, the hold back springs 126 are secured to vertically oriented pick adjustment blocks 206 mounted on the outer surfaces of the hopper walls 56. The hold back springs 126 ride up and down vertically on the pick rod 208 and are clamped into place by another screw handle **204*b***.

The case puller 68 is adjustable by having the case puller arm 150 ride inside a puller sleeve 210 and using another screw handle **204*e* to clamp the case puller arm into place where desired (see FIG. 4**).

The case bumper plate 122 is horizontally adjustable in a direction parallel to the longitudinal axis of the case erector 22 (see FIG. 2). The adjustment is accomplished by moving a bumper rod 212, which is attached to case bumper plate 122, within a bumper sleeve 214 which is connected to the frame 42. Once again, another screw handle **204*d* is used to clamp bumper rod 212** into place.

Upper guide angle is vertically adjusted for boxes of differing heights through the use of vertical guide angle rods 230 riding in guide angle sleeves 232. The guide angle sleeves are mounted on the outer face of the side guide angle 78. The guide angle rods 230 are clamped in position by screw handles 204 mounted in the guide angle sleeves 232 (see FIG. 2).

The side guide angle 78 is adjustable in a direction perpendicular to the longitudinal axis of the case erector 22 (see FIG. 2). Adjustment is accomplished through the use of a guide adjustment mechanism 216 which includes an adjustment wheel 218, a first guide shaft 220, a first interconnect member 222, a guide shaft drive 224, a second guide shaft 226, and a second interconnect member 228. The first and second guide shafts 220 lie at opposite ends of the case erection frame 42. The guide wheel 218 is fixed to the first guide shaft 220. The first guide shaft 220 is threaded along its middle portion, the threads engaging the first interconnect member 222. The second guide shaft 226 is also threaded and engages the second interconnect member 228. The first and second interconnect members are vertical arms on top of which is mounted the side guide angle 78. The guide shaft drive 224 interconnects the first and second guide shafts 220, 226, such that turning of first guide shaft results in turning of second guide shaft. Both shafts are therefore turned when the adjustment wheel 218 is turned. As the shafts turn, the lateral positioning of side guide angle 78 and upper guide angle 120 are adjusted.

A vertical adjustment mechanism 234 employing a single vertical adjustment wheel 236 is used to change the vertical positioning of both the major flap folder 90 and the tape applicator 112 (see FIG. 11). The vertical adjustment mechanism 234 also includes a top flap folder threaded shaft 238, a tape applicator threaded shaft 240, a vertical chain drive mechanism 242, flap folder sleeves 244, flap folder rods 246, a tape applicator sleeve 248, and a tape applicator rod 250. The vertical drive chain mechanism 242 interconnects the top flap folder threaded shaft 238 and the tape applicator threaded shaft 240 such that one full rotation of the top flap folder threaded shaft 238 causes a one-half rotation of the tape applicator threaded shaft 240. This 2:1 ratio is necessary since the tape applicator 112 is required to be positioned in the middle of a case 20. The tape applicator threaded shaft 240 engages the tape applicator rod 250. Rotational movement of tape applicator threaded shaft 240 causes the tape applicator rod 250 to vertically slide within tape applicator sleeve 248. The tape applicator rod 250 can be clamped securely to the tape applicator sleeve 248 by the use of another screw handle **204*f*. The vertical adjustment of the top major flap folder 90 is similar. The top flap folder threaded shaft 238 has its threads engaging a bracket between a pair of top flap folder rods 246 such that rotational movement of the threaded shaft 238 causes the rods 246 to vertically slide within sleeves 244. The top flap folder rods can be clamped in place by a pair of screw handles 204*g* and 204*h* mounted in the sleeves 244**.

The minor flap folders 80 may be adjusted horizontally along a path parallel to the longitudinal axis of case erector 22 (see FIG. 7). This is accomplished through the use of slide rods 152, slide sleeves 154, and a mounting plate 156. The mounting plate 156 is fixed to the pneumatic actuator 86 and to the slide sleeves 154. The slide sleeves 154 are slidably engaged to the slide rods 152 so that the entire minor flap folder mechanism 80 can be adjusted horizontally. The slide rods 152 are fixed to frame 42. Adjustment of the minor flap folders 80 along an axis parallel to the longitudinal axis of the case erector 22 is necessary to accommodate boxes of differing sizes since the minor flap folder arms 84 must rise above the deck 54 next to the bottom major flap 36 and rotate inwardly to the contact minor flaps 30, 32 of a case 20.

The arrangement of the present invention as described above provides numerous advantages over previous case erectors. The major advantage of the case erector 22 of the present invention is its compact size. Due to the fact that multiple functions are performed at one station, the case erector 22 is much smaller than previous case erectors. All flap folding, except for the bottom major flap 36, is performed while a case 20 is in a standstill position at the erection station 38. The folding of bottom major flap 36 is carried out very near erection station 38 just after case 20 begins to be conveyed toward the output end 46 of the case erector 22. The operation of taping the flaps together is performed as the case 20 is simply advanced toward the output end 46 of the case erector 22 just before it is ejected. This configuration of components provides a case erector whose length is just twice the length of the maximum knockdown case size. The compactness of the case erector 22 also makes it lighter weight and more mobile. Casters (not shown) may optionally be placed on the legs of the frame 42 of the case erector 22 to allow for greater ease of movement of the entire case erector. The case erector 22 can easily be set up by simply plugging it in and connecting a main air supply (not shown).

Because the case erector 22 is smaller it is also less costly to manufacture. This translates into a lower retail price making the case erector affordable to smaller quantity packagers.

While the presently preferred embodiment of the invention has been illustrated and described, it will be appreciated that various changes can be made therein without departing from the spirit and scope of the invention. Hence, within the scope of the appended claims it is to be understood that the invention can be practiced otherwise than as discussed hereinabove.

The embodiments of the invention in which an exclusive property or privilege is claimed are defined as follows:

1. An apparatus for erecting cases from flat blanks having a pair of minor flaps and a pair of major flaps, the apparatus comprising:

(a) a frame having a deck, an input end, and an output end;

(b) a hopper attached to the frame, disposed at the input end of the frame, for holding a plurality of flattened case blanks, the hopper having a loading end and a feed end;

(c) a case puller attached to the frame and disposed near the input end of said frame for pulling flattened cases one at a time from the feed end of the hopper into a tubular configuration with four faces, one of said faces lying on said deck;

(d) a trailing flap folder attached to the frame and disposed on one side of the case puller near the feed end of the hopper;

(e) a leading flap folder attached to the frame and disposed on the same side of the case puller as the trailing flap folder nearer the output end of the frame than the trailing flap folder;

(f) a top flap folder attached to the frame and positioned above the deck near the feed end of the hopper above the leading flap folder;

(g) a bottom flap folder attached to the frame and disposed beneath the deck nearer the output end of the frame than the leading flap folder, said bottom flap folder being arranged and configured to rise partially above the deck to fold the bottom flap of said tubular case lying on said deck; and (h) a case advancement mechanism coupled to the frame for advancing cases from the input end to the output end of said frame beyond the leading flap folder.

2. The apparatus of claim 1, further comprising a means for securing the flaps in a closed position, said means being coupled to the frame near the output end.

3. The apparatus of claim 2, wherein the securing means comprise a tape applicator.

4. The apparatus of claim 2, wherein said top flap folder comprises a linear actuator and a fold plate, said fold plate having a longitudinal axis lying parallel to the direction cases are advanced by said case advancement mechanism, at least a portion of the fold plate being above the bottom flap folder.

5. The apparatus of claim 4, wherein said case puller includes an arm, vacuum suction cups for attaching said arm to flattened cases in said hopper and pivot means for moving said arm between a vertical position whereat said vacuum suction cups are juxtaposed against a flattened case in said hopper and a position whereat said arm and said suction cups lie beneath said deck.

6. The apparatus of claim 5, wherein each of the trailing flap folder, the bottom flap folder, and the case advancement mechanism include means for moving beneath the deck when not in use.

7. The apparatus of claim 6, wherein the bottom flap folder is disposed on the output side of the leading flap folder, the bottom flap folder having means for actuating when the case is advanced at least partially past the bottom flap folder.

8. The apparatus of claim 7, further comprising adjustment means for adjusting the apparatus to the dimensions of cases of various sizes.

9. The apparatus of claim 1, wherein said case puller includes an arm, vacuum suction cups for attaching said arm to flattened cases in said hopper and pivot means for moving said arm between a vertical position whereat said vacuum suction cups are juxtaposed against a flattened case in said hopper and a position whereat said arm and said suction cups lie beneath said deck.

10. The apparatus of claim 1, wherein the case puller, the leading, trailing, top and bottom flap folders each include a separate pneumatic actuator, and wherein the movement of the case puller and the leading, trailing, top and bottom flap folders are all controlled by said pneumatic actuators.

11. The apparatus of claim 10, wherein the leading and trailing flap folders are disposed completely beneath the deck when not in use and are moved upwardly by their associated pneumatic actuators, and wherein the leading and the trailing flap folders further comprise leading and trailing flap folder arms and leading and trailing barrel cams having cam paths such that as said arms move upwardly, from beneath the deck, they also move inwardly, toward each other.

12. The apparatus of claim 1, wherein the case advancement mechanism comprises: a case pusher bar disposed beneath the deck that is extendible above the deck; a pusher bar pneumatic actuator for raising and lowering said case pusher bar; and a drive means for moving the case pusher bar in a direction parallel to the deck.

13. The apparatus of claim 1, wherein each of the trailing flap folder, the bottom flap folder, and the case advancement mechanism include means for moving beneath the deck when not in use.

14. The apparatus of claim 1, further comprising adjustment means for adjusting the apparatus to the dimensions of cases of various sizes.

15. The apparatus of claim 1, wherein the bottom flap folder is disposed on the output side of the leading flap folder, such that the bottom flap folder is actuated when the case is advanced at least partially past the bottom flap folder.

16. The apparatus of claim 1, further comprising guide members attached to the frame, said guide members configured and arranged to maintain the case in a proper position on the deck by substantially inhibiting lateral and vertical movement along at least a portion of the length of the deck.

17. The apparatus of claim 1, wherein the leading flap folder includes means for moving beneath the deck when not actuated.

18. A method of erecting a case with a case erector having an erection station, the case having four faces, a trailing flap, a leading flap, a top flap and a bottom flap, comprising the steps of:

a. loading the case into the case erector where it is gravity fed to the erection station in a closed, vertical position;
b. pulling the case from its closed, vertical position, opening and positioning the case at the erection station;
c. folding the leading and trailing flaps inwardly while the case is at the erection station;
d. folding the top flap downwardly while the case is at the erection station;
e. advancing the case partially away from the erection station;
f. folding the bottom flap as the case is being advanced from the erection station; and
g. advancing the case from the erection station until it is ejected from the case erector.

19. The method of claim 18, further comprising the step of securing the top and bottom flaps in place before the case is ejected from the case erector.

20. The method of claim 19, wherein the step of securing the top and bottom flaps includes applying a pressure sensitive tape across the top and bottom flaps.

21. An apparatus for erecting cases from flat blanks having leading and trailing minor flaps and top and bottom major flaps, the apparatus comprising:

a. a frame having a deck, an input end, and an output end;
b. a hopper attached to the frame and disposed at the input end of the frame, said hopper having a loading end, a feed end, and guide members arranged and configured to receive a plurality of the flat blanks;
c. a vacuum arm attached to the frame and disposed near the feed end of the hopper, said arm having vacuum suction cups and means to supply a vacuum of air to pull the flat cases from the feed end of the hopper into a tubular configuration with four faces, one of said faces being against the deck;
d. a trailing minor flap folder attached to the frame and arranged and configured to fold the trailing minor flap of a case after it has been pulled from the hopper, said trailing minor flap folder disposed on one side of the case puller near the feed end of the hopper;
e. a leading minor flap folder attached to the frame and arranged and configured to fold the leading minor flap of a case after it has been pulled from the hopper, said leading minor flap folder disposed on the same side of the case puller as the trailing minor flap folder being positioned nearer the output end of the frame than the trailing minor flap folder;
f. a top major flap folder attached to the frame and positioned above the deck near the feed end of the hopper for folding the top major flap after a case has been pulled from the hopper;

g. a bottom major flap folder attached to the frame and disposed beneath the deck, said bottom major flap folder being arranged and configured to rise partially above the deck to fold the bottom major flap;

h. a case pusher bar coupled to the frame for advancing a case out of the output end of the frame; and i. a tape applicator coupled to the frame and disposed above the deck adjacent to the bottom major flap folder, said applicator arranged and configured to apply a strip of pressure sensitive tape to across the major flaps, extending parallel to the deck.

22. An apparatus for erecting cases from flat blanks having a pair of minor flaps and a pair of major flaps, the apparatus comprising:

(a) a frame having a deck, an input end, and an output end;

(b) a hopper attached to the frame, disposed at the input end of the frame, for holding a plurality of flattened case blanks, the hopper having a loading end and a feed end;

(c) a case puller attached to the frame and disposed near the input end of said frame for pulling flattened cases one at a time from the feed end of the hopper into a tubular configuration with four faces, one of said faces lying on said deck, the puller being disposed beneath the deck when not actuated;

(d) a trailing flap folder attached to the frame and disposed on one side of the case puller near the feed end of the hopper;

(e) a leading flap folder attached to the frame and disposed on the same side of the case puller as the trailing flap folder nearer the output end of the frame than the trailing flap folder, the leading flap folder including means for moving beneath the deck when not actuated;

(f) a top flap folder attached to the frame and positioned above the deck near the feed end of the hopper above the leading flap folder;

(g) a bottom flap folder attached to the frame and disposed beneath the deck nearer the output end of the frame than the leading flap folder, said bottom flap folder being arranged and configured to rise partially above the deck to fold the bottom flap of said tubular case lying on said deck; and (h) a case advancement mechanism coupled to the frame for advancing cases from the input end to the output end of said frame beyond the leading flap folder.

* * * * *